United States Patent [19]

Gamble

[11] 4,001,815

[45] Jan. 4, 1977

[54] ROTARY ELECTROMAGNETIC INDICATOR

[75] Inventor: John G. Gamble, Simsbury, Conn.

[73] Assignee: Veeder Industries, Inc., Hartford, Conn.

[22] Filed: June 5, 1975

[21] Appl. No.: 584,218

[52] U.S. Cl. ..... 340/373; 340/379; 335/268

[51] Int. Cl.[2] ..... G08B 5/00

[58] Field of Search ..... 340/378 R, 378 MW, 379, 340/373; 335/272

[56] References Cited

UNITED STATES PATENTS

| | | | |
|---|---|---|---|
| 3,470,509 | 9/1969 | Silverman et al. | 335/272 |
| 3,588,888 | 6/1971 | Harden | 340/378 MW |
| 3,732,561 | 5/1973 | McGinnis | 340/378 R |
| 3,735,303 | 5/1973 | Harden | 340/378 R X |

*Primary Examiner*—John W. Caldwell
*Assistant Examiner*—William M. Wannisky
*Attorney, Agent, or Firm*—Prutzman, Hayes, Kalb & Chilton

[57] ABSTRACT

A rotary electromagnetic indicator having a stator with an annular arrangement of five equiangularly spaced radially inwardly extending salient poles, a winding on each stator pole and an indicating rotor having a permanent magnet with diametrically opposed north and south salient poles, each having an angular width equal to the included angle of a pair of adjacent salient poles of the stator.

8 Claims, 2 Drawing Figures

10
12
14
16
30
34
46
56
26
65
24
22
11
52

10
11
12
14
16
20
22
24
26
30
34
36
40
42
46
50
52
56
58
60
61
64
65
67
N
S
CIRCUIT

ROTARY ELECTROMAGNETIC INDICATOR

BRIEF SUMMARY OF THE INVENTION

The present invention relates to a new and improved rotary electromagnetic indicator of the type having a permanent magnet indicating rotor with diametrically opposed north and south poles, and a stator with a stator core with an annular arrangement of a plurality of equiangularly spaced salient poles and adapted to be selectively energized for magnetically positioning the rotor.

It is a principal aim of the present invention to provide a new and improved rotary electromagnetic indicator of the type described adapted to be successively indexed from one indicating rest position thereof to another indicating rest position thereof at a high indexing rate.

It is another aim of the present invention to provide in a rotary electromagnetic indicator of the type described, a new and improved rotor permanent magnet configuration for accurately locating the rotor at each of a plurality of indicating positions thereof and for reducing or eliminating rotor overshoot as the rotor is indexed from one position to another position.

It is a further aim of the present invention to provide a rotary electromagnetic indicator having improved magnetic efficiency and an improved torque/power ratio.

It is another aim of the present invention to provide a new and improved rotary electromagnetic indicator of the type having an uneven plurality of equiangularly spaced salient stator poles with corresponding salient pole windings, each adapted to be selectively energized, for selectively positioning a permanent magnet rotor in each of an even plurality of equiangularly spaced rotor positions equal to twice the number of salient stator poles. In accordance with the present invention, the rotor permanent magnet is configured so that one of the stator pole windings can be selectively energized to attract a selected one of the permanent magnet poles of the rotor and the opposite pair of stator pole windings can be selectively energized to attract the opposite permanent magnet pole of the rotor and whereby a selected set of three stator pole windings can be appropriately energized to selectively position the rotor in each of its indicating positions.

Other objects will be in part obvious and in part pointed out more in detail hereinafter.

A better understanding of the invention will be obtained from the following detailed description and the accompanying drawing of an illustrative application of the invention.

DESCRIPTION OF THE PREFERRED EMBODIMENT

Figure 2:
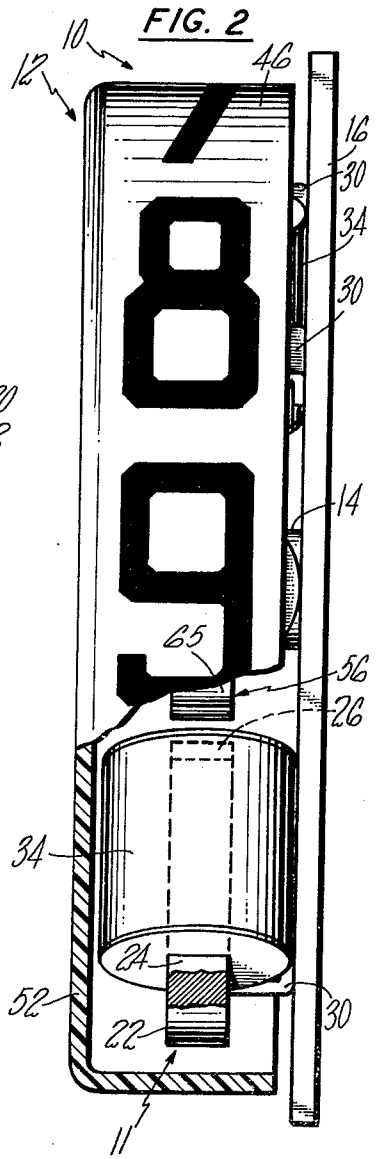
FIG. 2 is a front elevation view, partly broken away and partly in section, of the rotary electromagnetic indicator.

Referring now to the drawing in detail wherein like numerals are used to represent like parts, a preferred embodiment 10 of a rotary electromagnetic indicator incorporating the present invention comprises a five pole stator 11 and a permanent magnet indicating rotor 12 rotatably mounted on a stub shaft 14 suitably fixed to a printed circuit board 16. The stator 11 comprises a flat stator core 20 having an outer circular ring 22 coaxial with the indicating rotor 12 and an annular arrangement of five radially inwardly extending salient poles 24 with corresponding generally flat salient pole faces 26. The radial axes of the five salient poles 24 and their pole faces 26 are equiangularly spaced (i.e., 72°) about the rotor axis, and the stator pole faces 26 are preferably at the same radial distance from the rotor axis. Also, the stator pole faces 26 have substantially the same angular or circumferential width of, for example, 18°. The flat stator core 20 (which, for example, may be made of soft iron laminations or injection molded of a suitable molded magnetic plastic) is mounted on the PC board 16 with suitable angularly spaced supports or standoffs 30 secured to the PC board.

A separate salient pole winding 34 is mounted on each of the five salient poles 24 and with its two leads 36 soldered to the PC board 16 to provide electrical connections between a PC board circuit generally denoted by the numeral 40 and each of the stator windings 34. The PC board 16 has suitable printed circuit connectors 42 for supplying electrical power to the rotary electromagnetic indicator 10 and for transmitting electrical input and output signals (depending upon the design and application of the electromagnetic indicator 10) to and from the indicator 10. For example, the rotary electromagnetic indicator 10 may be employed as a ten position decade indicator as described in the copending U.S. patent application Ser. No. 584,216 entitled "Counting and Indicating System" of Donald W. Fleischer filed concurrently herewith, in which case, the circuit 40 and connectors 42 could be provided as described in that application.

The indicating rotor 12 is shown having an outer cylindrical indicating rim 46 encircling and completely enclosing the stator 11 and bears the digits of the digital sequence 0-9 equiangularly thereabout in a conventional manner. Thus, the shown embodiment has primary utility as a single place decade indicator, for example, in a counter for displaying the digits 0-9 respectively in sequence.

The indicating rotor 12 has a molded plastic support having a central hub 50 rotatably mounted on the fixed stub shaft 14, the numeral bearing rim 46 and an intermediate web 52 integrally connecting the hub 50 and numeral bearing rim 46. A flat permanent magnet 56 is secured to the rotor hub 50 for rotation within the plane of and for alignment of its north and south salient magnetic poles 60, 61 with the salient poles 24 of the stator 11 and so that the permanent magnet 56 (and, therefore, the entire indicating rotor 12) is adapted to be angularly positioned by the stator field.

The permanent magnet 56 has a diametral axis 58 which also can be considered to be the magnetic axis of the permanent magnet 56 even though the internal magnetic path of the permanent magnet 56 between its diametrically opposed north and south poles 60, 61 extends generally circumferentially around the rotor hub 50. The flat permanent magnet 56 is configured to have truncated magnetic pole sectors 60, 61 of substantially identical shape with angularly extending substantially identical north and south pole faces 64, 65 respectively and generally radially extending edges 67. The north and south pole faces 64, 65 extend circumferentially to form portions of a circle coaxial with the indicating rotor. The stator pole faces 26, though flat, also generally form portions of a slightly larger coaxial circle to define a slight air gap between the stator and rotor pole faces.

Figure 1:
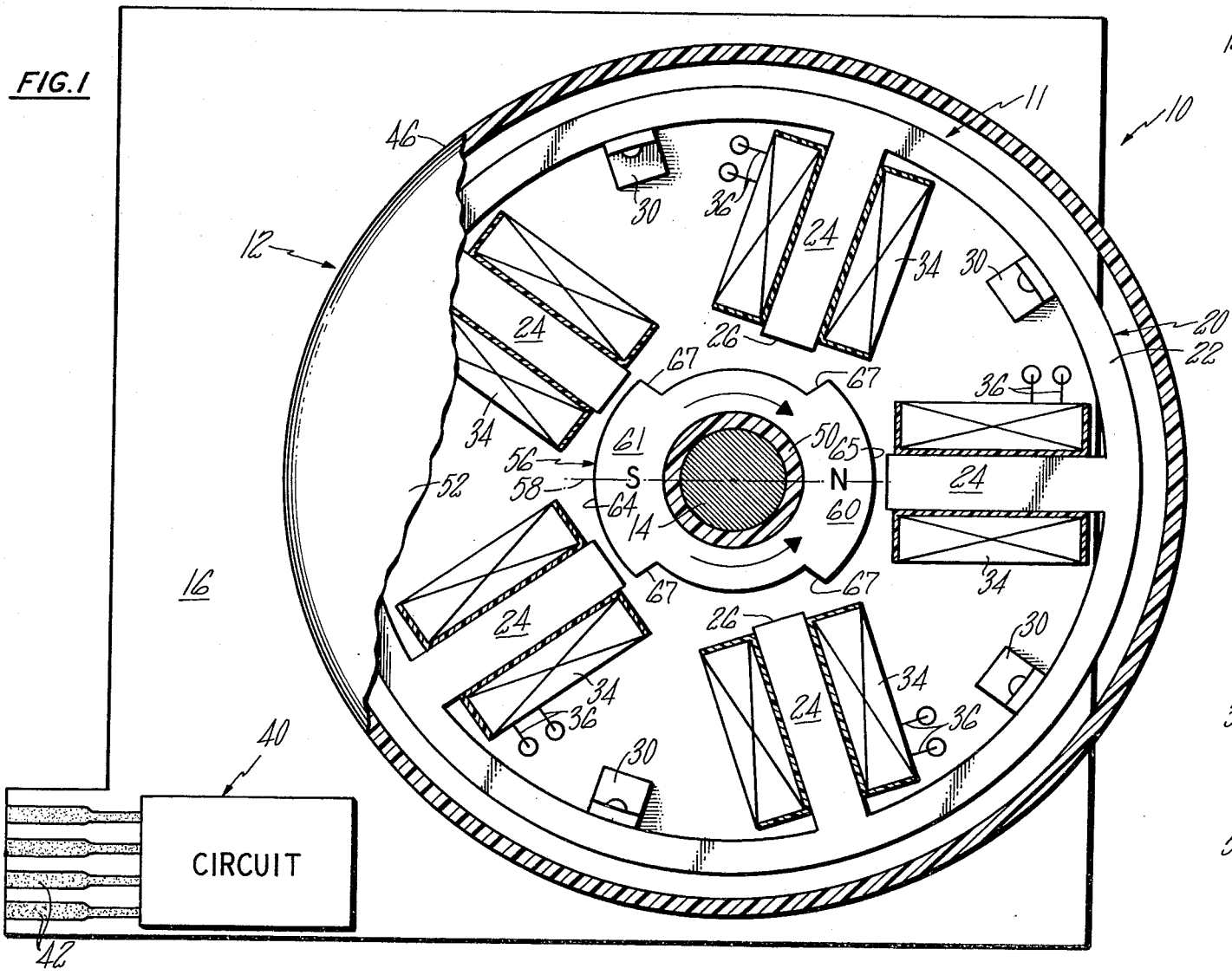
FIG. 1 is a side elevation view, partly broken away and partly in section, of a rotary electromagnetic indicator incorporating an embodiment of the present invention.

Each permanent magnet pole face 64, 65 extends angularly and circumferentially in both angular directions from the diametral axis 58 and the total circumferential and angular width of each pole face 64, 65 is preferably not greater than and is substantially equal to the included angle of any pair of adjacent stator poles and stator pole faces 26 (i.e., 90° where there are five equiangularly spaced stator poles 24, having an angular spacing of 72°, and wherein each of pole faces 26 has an angular width of 18° as previously described). Accordingly, as shown in FIG. 1, each of the salient poles 60, 61 of the permanent magent has an angular and circumferential width whereby it is adapted to fully overlap and be in alignment with each of a pair of adjacent stator pole faces 26.

In each of the ten equiangularly spaced readout positions of the indicating rotor 12, one of its permanent magnet poles 60, 61 (hereinafter referred to as the "primary" rotor pole) is centrally aligned with one of the five stator poles 24 (hereinafter referred to as the "primary" stator pole) and the other or "secondary" rotor pole 60, 61 is aligned with the opposite pair of "secondary" stator poles 24 (i.e., the permanent magnet 56 is angularly aligned so that the diametral axis 58 is aligned with the radial axis of the "primary" stator pole and the diametral axis 58 bisects the angle between the radial axes of the opposite pair of secondary stator poles 24, all shown in FIG. 1).

Thus, in each rotor indicating position, although the primary rotor pole 60, 61 extends angularly somewhat in each angular direction from the primary stator pole 24 toward the adjacent stator poles 24, the remaining air gap between the primary rotor pole and the adjacent stator poles is substantially greater than its air gap with the primary stator pole. Also, and in contrast, the secondary rotor pole 60, 61 is angularly aligned so that its outer generally radial edges 67 are in substantial radial alignment with the outer edges of the pair of secondary stator poles 24 and such that the secondary rotor and stator poles completely overlap.

The indicating rotor is adapted to be positioned in any selected digit position by selectively magnetizing the appropriate stator pole 24 (with its winding 34) as the primary pole and with the appropriate polarity to attract the appropriate primary rotor pole 60, 61 and by magnetizing the opposite pair of secondary stator poles (with their windings 34) with the opposite polarity to center the secondary rotor pole in overlapping relationship therewith. Accordingly, a selected set of three stator coils are appropriately energized to selectively position the rotor in each of its ten indicating positions. Alternatively, a single selected primary stator coil 34 (encircling the selected primary stator pole) can be selectively energized to selectively position the indicating rotor in one of its 10 digit positions. In either case, the active coil or coils can be maintained energized to hold the indicating rotor in the selected position or, if desired, the active coil or coils can be de-energized after the rotor is positioned. In the latter case, the rotor will then remain magnetically held in its selected indicating position by the magnetic detenting or attraction between the salient poles of the permanent magnet 56 and the primary and secondary poles 24 of the stator.

The permanent magnet rotor can be successively indexed from any one angular indicating position to successive selected angular indicating positions by appropriately energizing, in the desired order, the appropriate sets of three primary and secondary windings 34 (or by appropriately energizing only the appropriate primary windings 34) for the selected indicating positions respectively. The rotor will rotate rapidly to each selected position because of the efficient magnetic interaction between the salient poles of the stator and rotor. In that regard, the air gap reluctance decreases in steps as the rotor approaches each selected indicating position and as the salient poles of the rotor rotate into overlapping or aligned relationship with the primary and secondary salient poles of the stator. The first such step occurs as the secondary rotor pole rotates into overlapping or aligned relationship with the first or leading secondary stator pole (that aligned or overlapping relationship being present at the beginning of the indexing cycle where the rotor 12 is indexed only 36° or one count to its next position). The second step occurs as the primary rotor pole rotates into overlapping or aligned relationship with the primary stator pole (that relationship also being present at the beginning of a one count or 36° stepping cycle). A third step occurs as the secondary rotor pole rotates into overlapping or aligned relationship with the second or trailing secondary stator pole. That multiple step magnetic interaction provides for reducing the air gap reluctance and, therefore, for improving the magnetic efficiency of the total magnetic circuit and whereby the rotor can be angularly indexed to successive rest indicating positions at a high rate. Rotor overshoot past each selected indicating position is attenuated or damped by the resulting high rate of increase of reluctance between the secondary rotor pole and the leading secondary stator pole. Similarly, a reverse swing of the rotor past its selected indicating position is attenuated or damped by the resulting high rate of increase of reluctance between the secondary rotor pole and the trailing secondary stator pole. Accordingly, the geometry of the rotor permanent magnet 56 provides for effectively damping and practically eliminating rotor oscillations at the selected indicating position and such that the rotor is rapidly brought to rest at each selected indicating position. The rest position to rest position indexing interval is therefore substantially shorter than would otherwise be the case and the available rest position to rest position indexing rate, for example, for indexing the rotor to successive positions for counting, is accordingly substantially higher than would otherwise be the case.

As will be apparent to persons skilled in the art, various modifications, adaptations and variations of the foregoing specific disclosure can be made without departing from the teachings of the present invention.

I claim:

1. In a rotary indicator comprising an indicating rotor having a permanent magnet with diametrically opposed north and south salient magnetic poles with two diametrically opposed pole faces respectively, each extending angularly substantially equally in both angular directions from a diametral axis of the rotor, a stator core having an uneven plurality of salient poles with pole faces respectively equiangularly spaced about the axis of the indicating rotor for magnetic cooperation with the north and south poles of the rotor permanent magnet, the stator pole faces having substantially the same angular width, a stator winding on each of the stator poles, each stator winding being adapted to be selectively energized for selectively magnetically positioning the indicating rotor in each of two 180° reverse indicating positions thereof with said diametral axis aligned with the respective stator pole face; the improvement wherein each of the two diametrically opposed pole faces of the rotor permanent magnet has an angular width greater than the equiangular spacing of the stator pole faces by an amount no greater than said angular width of the stator pole faces whereby any one of the stator windings can be selectively energized to align a selected rotor pole face with the respective stator pole face and to align the opposite rotor pole face with the opposite pair of stator pole faces.

2. A rotary indicator according to claim 1 wherein the stator comprises five of said salient poles for angularly positioning the indicating rotor in each of ten equiangularly spaced positions.

3. A rotary indicator according to claim 1 wherein the stator core comprises an annular ring generally coaxial with the rotor, wherein the salient stator poles extend radially inwardly from the annular ring within a plane generally normal to the axis of the indicating rotor and have radially inwardly facing pole faces respectively, and wherein the permanent magnet is generally flat and is radially inwardly of the stator pole faces substantially in the plane of the stator poles.

4. A rotary indicator according to claim 1 wherein each of the pole faces of the rotor permanent magnet has an angular width approximately equal to the sum of said equiangular spacing of the stator pole faces and said angular width of the stator pole faces.

5. A rotary indicator according to claim 1 wherein each pole face of the rotor permanent magnet has a substantially constant radius along the full angular width thereof.

6. In a rotary indicator comprising an indicating rotor having a permanent magnet with generally diametrically opposed north and south salient magnetic poles with two diametrically opposed pole faces respectively, each extending angularly substantially equally in both angular directions from a diametral axis of the rotor, a stator core having an uneven plurality of salient poles with pole faces respectively equiangularly spaced about the axis of the indicating rotor for magnetic cooperation with the north and south salient poles of the rotor permanent magnet, the stator pole faces having substantially the same angular width, stator winding means adapted to be selectively energized for selectively magnetizing the stator for selectively magnetically positioning the indicating rotor in each of a plurality of angularly spaced indicating positions thereof, each with said diametral axis aligned with one of the stator pole faces; the improvement wherein each of the two diametrically opposed pole faces of the rotor permanent magnet has an angular width greater than the equiangular spacing of the stator pole faces by an amount no greater than said angular width of the stator pole faces whereby the stator winding means can be selectively energized to align a selected pole face of the rotor permanent magnet with a selected pole face of the stator and align the opposite rotor pole face in overlapping relationship with the opposite pair of stator pole faces.

7. A rotary indicator according to claim 6 wherein each of the pole faces of the rotor permanent magnet has an angular width approximately equal to the sum of said equiangular spacing of the stator pole faces.

8. A rotary indicator according to claim 6 wherein each pole face of the rotor permanent magnet has a substantially constant radius along the full angular width thereof.

* * * * *